US011453536B2

(12) United States Patent
Lazarus

(10) Patent No.: US 11,453,536 B2
(45) Date of Patent: Sep. 27, 2022

(54) TIERED SERVING BOWL WITH LIP

(71) Applicant: Michael Philip Lazarus, Scotts Valley, CA (US)

(72) Inventor: Michael Philip Lazarus, Scotts Valley, CA (US)

( * ) Notice: Subject to any disclaimer, the term of this patent is extended or adjusted under 35 U.S.C. 154(b) by 0 days.

(21) Appl. No.: 16/365,682

(22) Filed: Mar. 27, 2019

(65) Prior Publication Data

US 2020/0307874 A1 Oct. 1, 2020

(51) Int. Cl.

| | |
|---|---|
| ***B65D 51/24*** | (2006.01) |
| ***B65D 21/02*** | (2006.01) |
| ***A47G 19/30*** | (2006.01) |

(52) U.S. Cl.

CPC ..... *B65D 51/24* (2013.01); *B65D 21/0201* (2013.01); *A47G 19/30* (2013.01)

(58) Field of Classification Search

CPC ..... A47G 19/08; A47J 45/07; B44D 3/126; B44D 3/128

See application file for complete search history.

(56) References Cited

U.S. PATENT DOCUMENTS

| | | | | |
|---|---|---|---|---|
| D180,329 | S * | 5/1957 | Highberger | D7/587 |
| 3,837,034 | A * | 9/1974 | Leffert | B44D 3/123 15/257.06 |
| 5,746,345 | A * | 5/1998 | Zurawin | B44D 3/126 220/735 |
| 6,382,459 | B1 * | 5/2002 | Liu | A47G 19/08 220/719 |
| 2007/0059461 | A1 * | 3/2007 | Carr | B65D 85/72 428/34.1 |
| 2009/0108004 | A1 * | 4/2009 | Bollengier | B65D 43/0202 220/574 |
| 2014/0076909 | A1 * | 3/2014 | Gang | B44D 3/14 220/737 |

* cited by examiner

*Primary Examiner* — Andrew T Kirsch
(74) *Attorney, Agent, or Firm* — Michael A. Guth

(57) ABSTRACT

A tiered bowl system adapted for use as a dipping bowl, such as with salsa, for example. The bowl may have a forward portion with a rim at a first, lower, level and a rear portion with a rim of a second, higher, level. A lip may be attached to the rear portion which partially protrudes over the bowl. The tiered bowl system allows a user to dip into the bowl, and then to partially remove some of the material acquired from the dipping using the lip. The lip may be easily removable and replaceable to assist with cleaning and stacking of the bowl system.

10 Claims, 18 Drawing Sheets

TIERED SERVING BOWL WITH LIP

FIELD OF THE INVENTION

This invention relates to a serving bowl, namely a serving bowl with a tiered top edge and overhanging lip.

BACKGROUND OF THE INVENTION

What is called for is a serving bowl system allows a user access to a dipping food material within a tiered bowl, and which allows the user to wipe material against a protruding lip affixed to a portion of the bowl.

SUMMARY

A tiered bowl system adapted for use as a dipping bowl, such as with salsa, for example. The bowl may have a forward portion with a rim at a first, lower, level and a rear portion with a rim of a second, higher, level. A lip may be attached to the rear portion which partially protrudes over the bowl. The tiered bowl system allows a user to dip into the bowl, and then to partially remove some of the material acquired from the dipping using the lip. The lip may be easily removable and replaceable to assist with cleaning and stacking of the bowl system.

DETAILED DESCRIPTION

Figure 1:
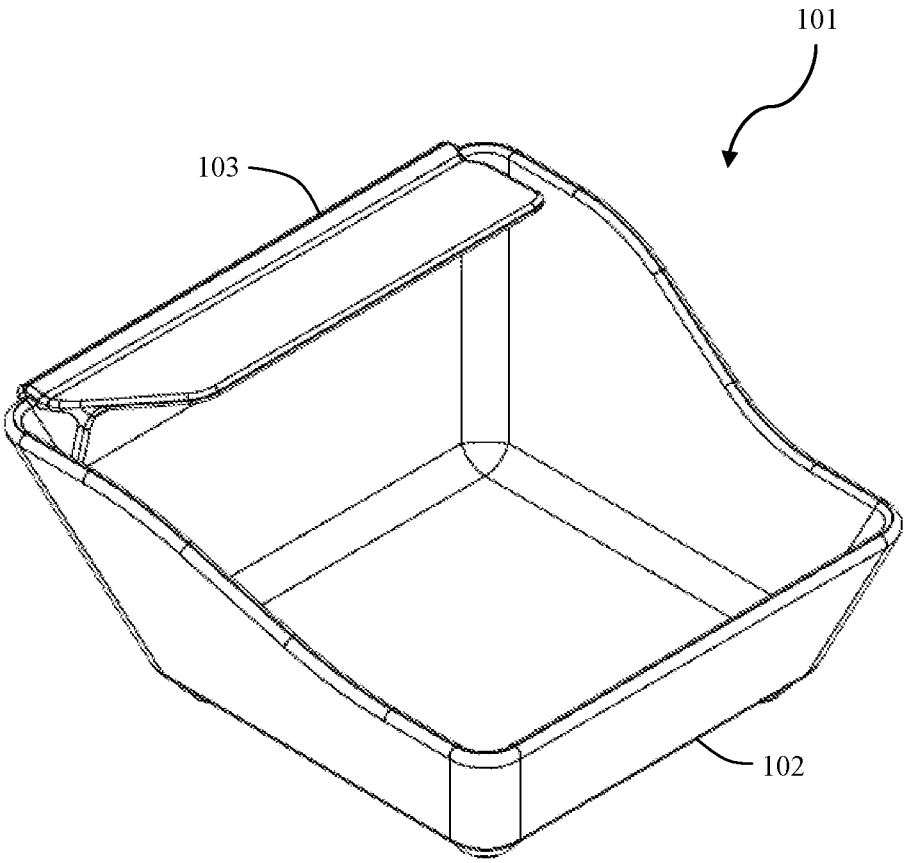
FIG. 1 is a raised view of a tiered bowl with lip according to some embodiments of the present invention.
Figure 2:
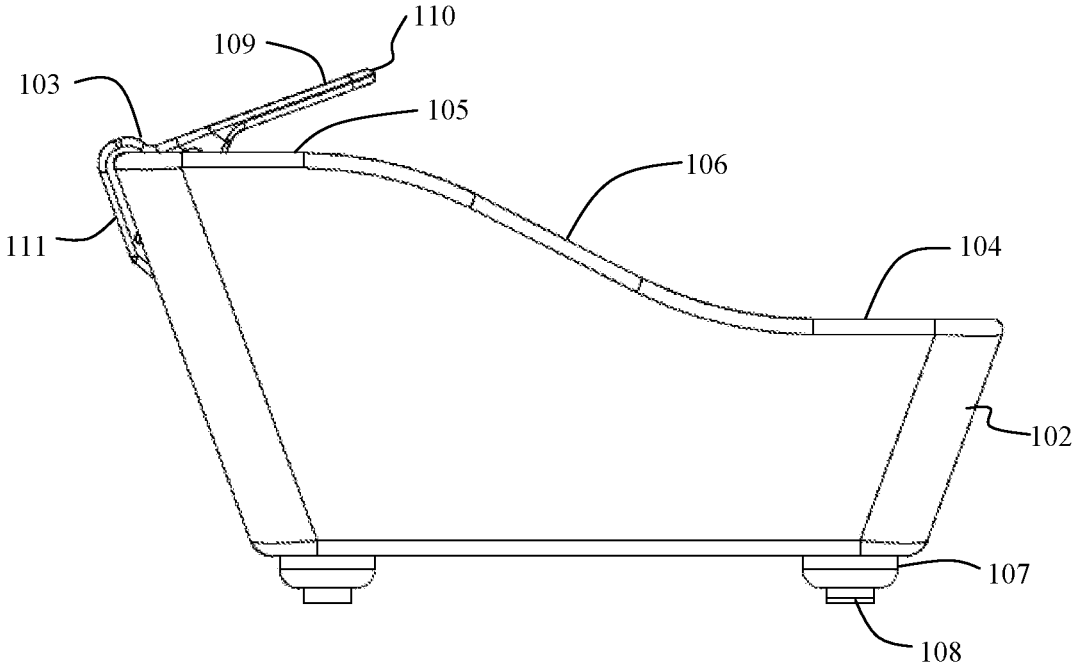
FIG. 2 is a side view of a tiered bowl with lip according to some embodiments of the present invention.

In some embodiments of the present invention, as seen in FIG. 1, a tiered bowl system 101 is seen with a tiered bowl 102 and a bowl lip 103. The tiered bowl is adapted to contain a material such as a food meant to be dipped into, as with tortilla chips, for example. In an exemplary use, the bowl 102 may hold a thicker dipping material, such as guacamole. A user may then dip a tortilla chip into the guacamole, and is able to remove some of the guacamole by wiping it against the underside of the bowl lip 103.

In some aspects, the bowl lip 103 may be removable such that the tiered bowls 102 are easily stacked for storage. A removable bowl lip may also allow for the customization of the bowl lip, such as branding with a corporate logo, or of a restaurant identification, or with a commemoration of a special event, such that the customization need only involve the bowl lip and not the bowl, such that the bowl may remain generic.

FIGS. 2-6 illustrate a side, top, front, rear, and bottom view of the tiered bowl system, respectively, of a tiered bowl system 101 according to some embodiments of the present invention. The tiered bowl 102 may have a tiered bowl encompassed by a front 115, sides 113, 114, a rear 116, and a bottom 112. The sides 113, 114 may have a top surface having a first, lower, portion 104 which may the same height as the top surface of the front 115. The top surface of the sides 113, 114 may also have a second, higher, portion 105 which may be the same height of the top surface of the rear 116. An intermediate portion 106 may bridge the first portion 104 and the second portion 105 of the sides 113, 114. In some aspects, a tiered effect may be implemented with a sloping side of the tiered bowl 102. In such a case, the top of the rear 116 of the bowl 102 would be at a higher elevation than the elevation of the top of the front 115. In some aspects, the top of the sides 113, 114 may descend from the top of the rear 116 to the front 115 using a different profile. In some aspects, the top of the rear 116 of the bowl 102 may extend higher than the top of the sides 113, 114 and the top of the front 115.

The bowl lip 103 has an overhang 109 out to a lip edge 110. A back portion 111 of the bowl lip resides along the top back of the rear 116 of the tiered bowl 102. The tiered bowl 102 may have a foot 107 in each corner. A pad 108 may be inserted in to the foot 107 to provide frictional grip for the tiered bowl system 101. In some aspects, the bowl lip 103 may be removable from the tiered bowl 102. The bowl lip 103 may be adapted to be attached to the rear of the bowl 102 such that a strong frictional grip or a slotted or keyed mechanical lock attaches the lip to the bowl with sufficient grip that the lip is not subject to accidental removal during typical operation as food dipping bowl. A feature on the upper back surface of the rear 116 of the bowl 102 may fit into a mating feature on the inner surface of the back portion 111 of the bowl lip 103. In some aspects, there may be raised features on the upper back surface of the rear 116 of the bowl 102, and matching recesses on the inner surface of the back portion 111 of the bowl lip 103. As the bowl lip is pushed down onto the rear 116 of the bowl 102, the opening in the bowl lip may spread slightly to allow the raised features to slide up until the mating recesses are engaged. The bowl lip 103 is adapted to be removed with relative ease to allow for cleaning and disassembly, although requiring force larger than expected during typical use as a food serving and dipping bowl. In some aspects, there is a lip only on the rear of the bowl.

Figure 3:
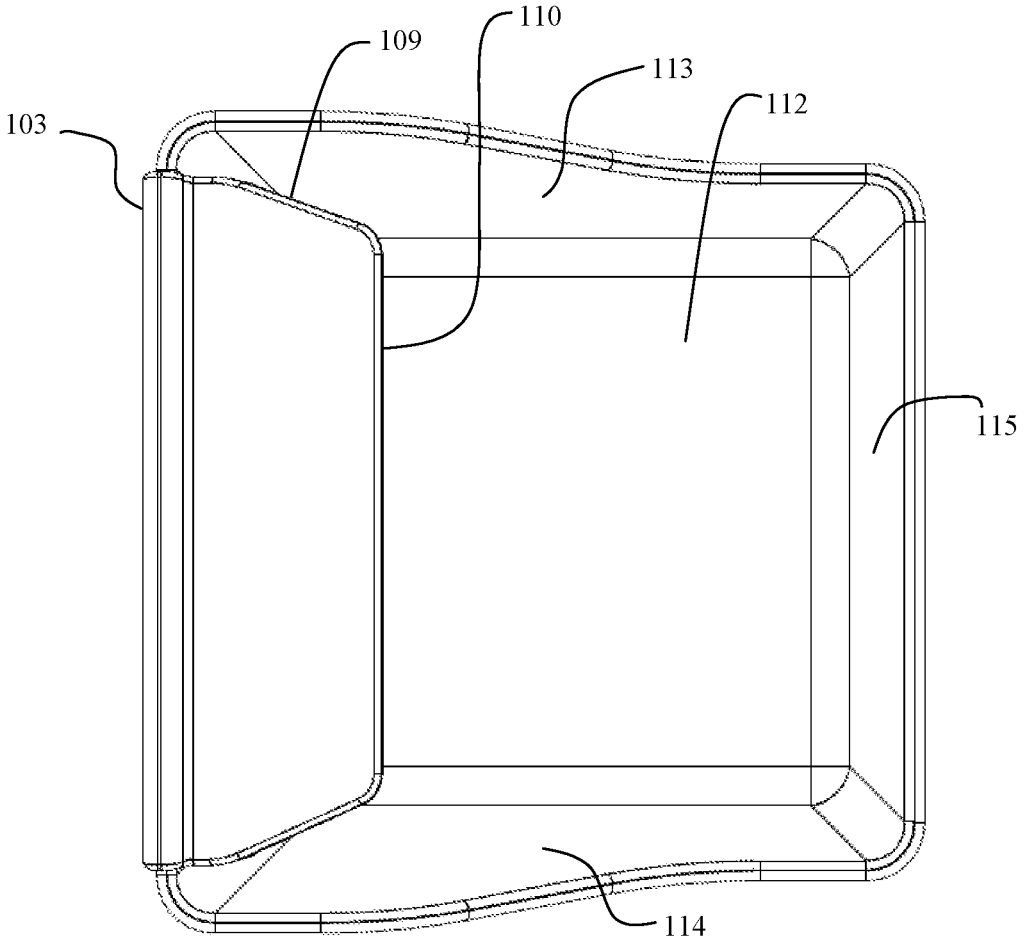
FIG. 3 is a top view of a tiered bowl with lip according to some embodiments of the present invention.
Figure 4:
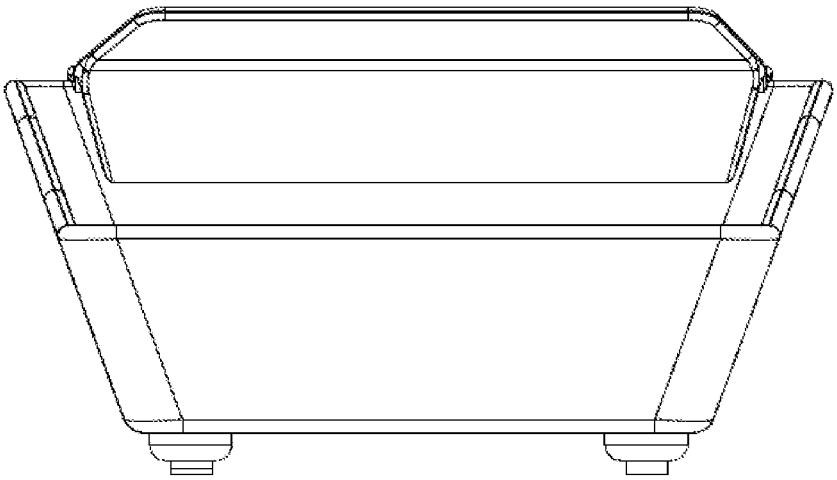
FIG. 4 is a front view of a tiered bowl with lip according to some embodiments of the present invention.
Figure 5:
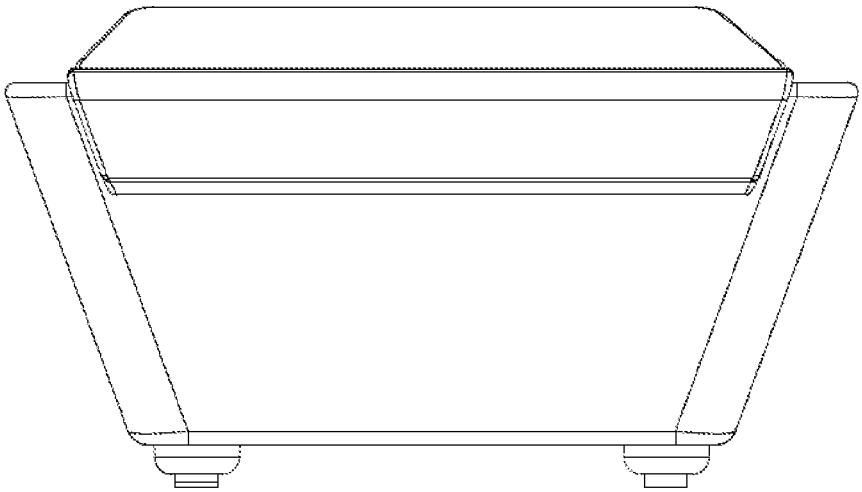
FIG. 5 is a back view of a tiered bowl with lip according to some embodiments of the present invention.
Figure 6:
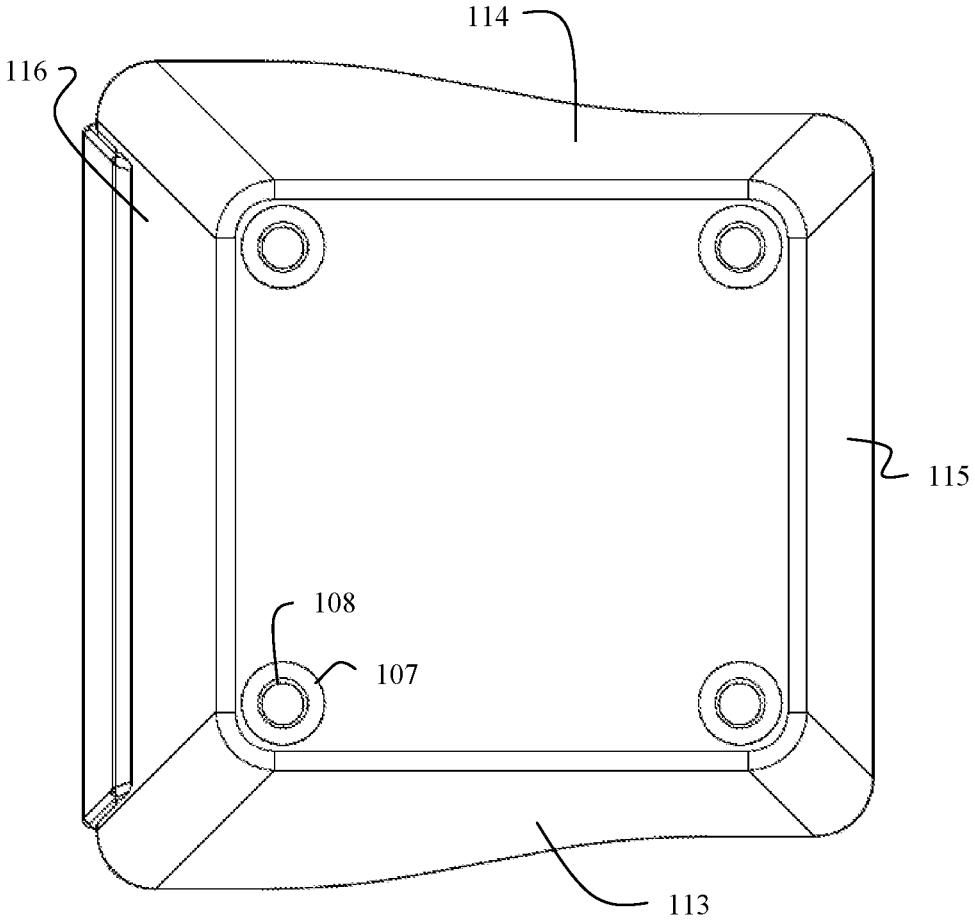
FIG. 6 is a bottom view of a tiered bowl with lip according to some embodiments of the present invention.
Figure 24:
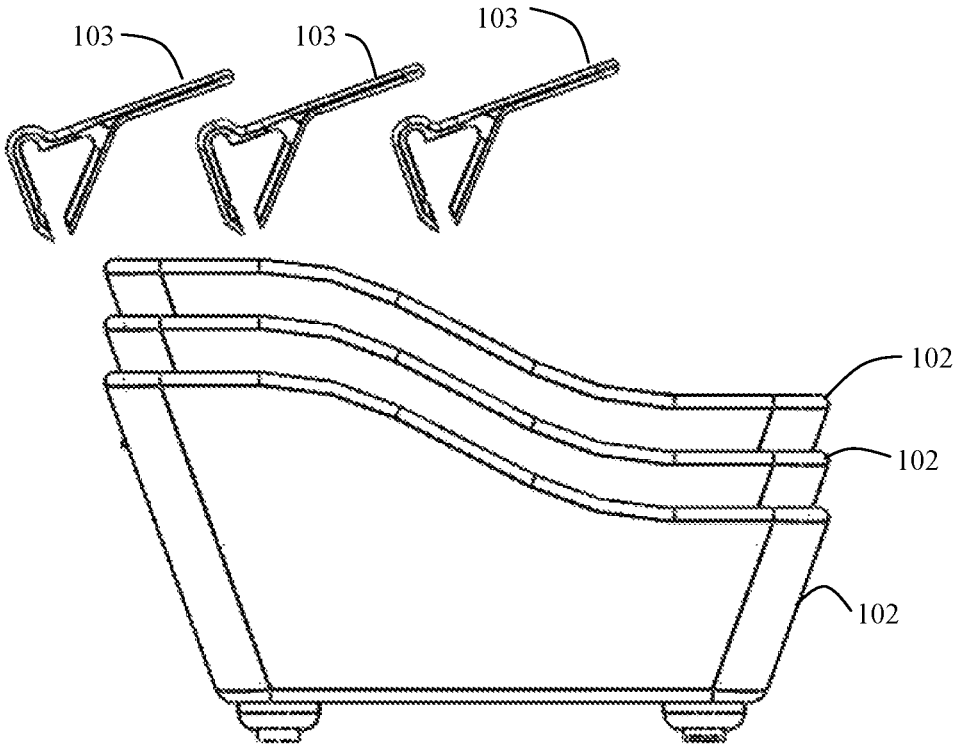
FIG. 24 is a side view of stacked bowls according to some embodiments of the present invention.
Figure 25:
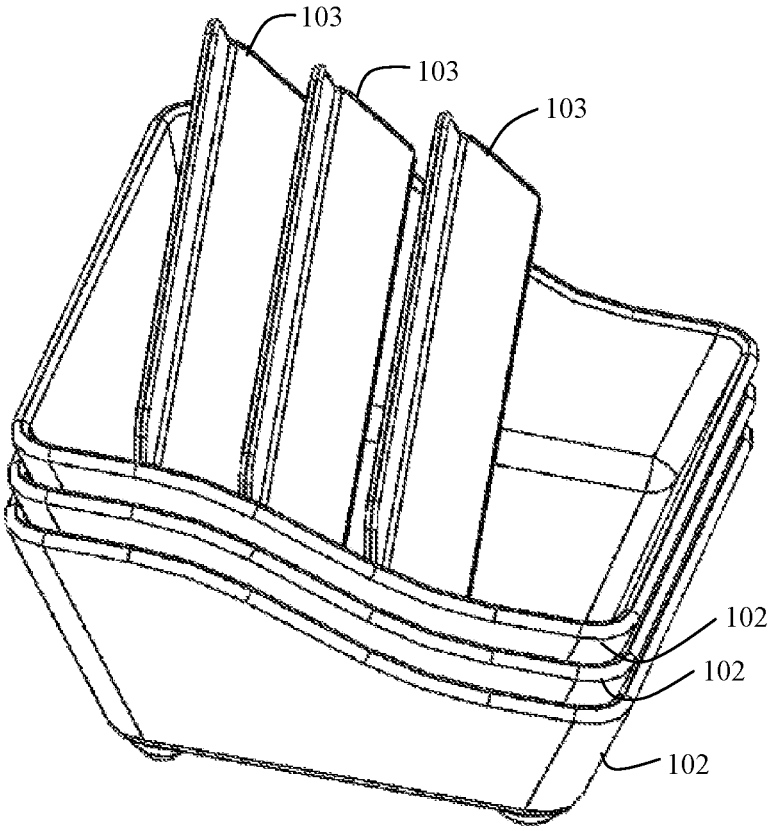
FIG. 25 is a raised view of stacked bowls according to some embodiments of the present invention.

FIG. 3 illustrates in top view the relative extension of the overhang 109 out to the lip edge 110 across the tiered bowl 102 in an exemplary embodiment. In this exemplary embodiment, the inner surfaces of the sides 113, 114, of the front 115, and of the rear 116 of the bowl 102 slope inwards as they descend towards the bottom 112. The sloping sides of the bowl may facilitate stacking of the bowls, as seen in FIGS. 24 and 25. The interfaces of the front, sides, and rear of the bowl with the bottom of the bowl may have fillets in some aspects.

In an exemplary use, a food item, such as a guacamole dip, may be placed into the tiered bowl 102. The food item may reside on the bottom 112 of the bowl, and held within the front 115, sides 113, 114, and rear 116. A user may use a dipping item, such as a tortilla chip, into the bowl. The user may then want to wipe off of a portion of the dipping item, and this can be done be wiping against the underside of the overhang and against the lip edge. Further, the tiered aspect of the bowl allows full and better access for the dipping item into the bowl, as well as vision for the user into the bowl.

In an exemplary embodiment, both the tiered bowl and the bowl lip 103 may be made of a food grade polypropylene. The thickness of the front, sides, rear, and bottom may be 0.125 inches thick in an exemplary embodiment. The internal edges at the bottom of the bowl may be have a larger radius to accommodate scooping of the food item by the dipping item.

Figure 7:
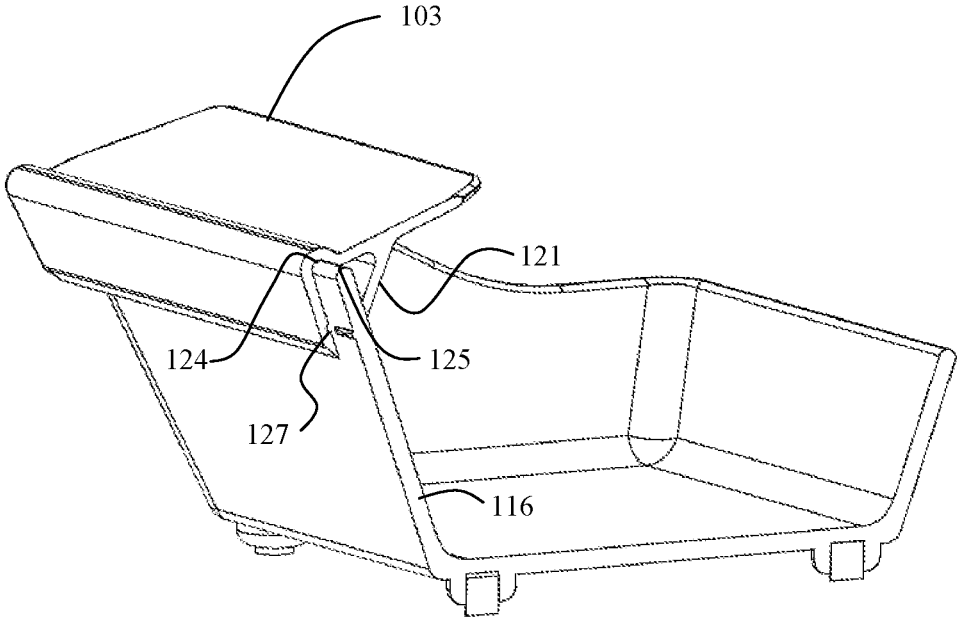
FIG. 7 is a partial cutaway view of a tiered bowl with lip according to some embodiments of the present invention.
Figure 8:
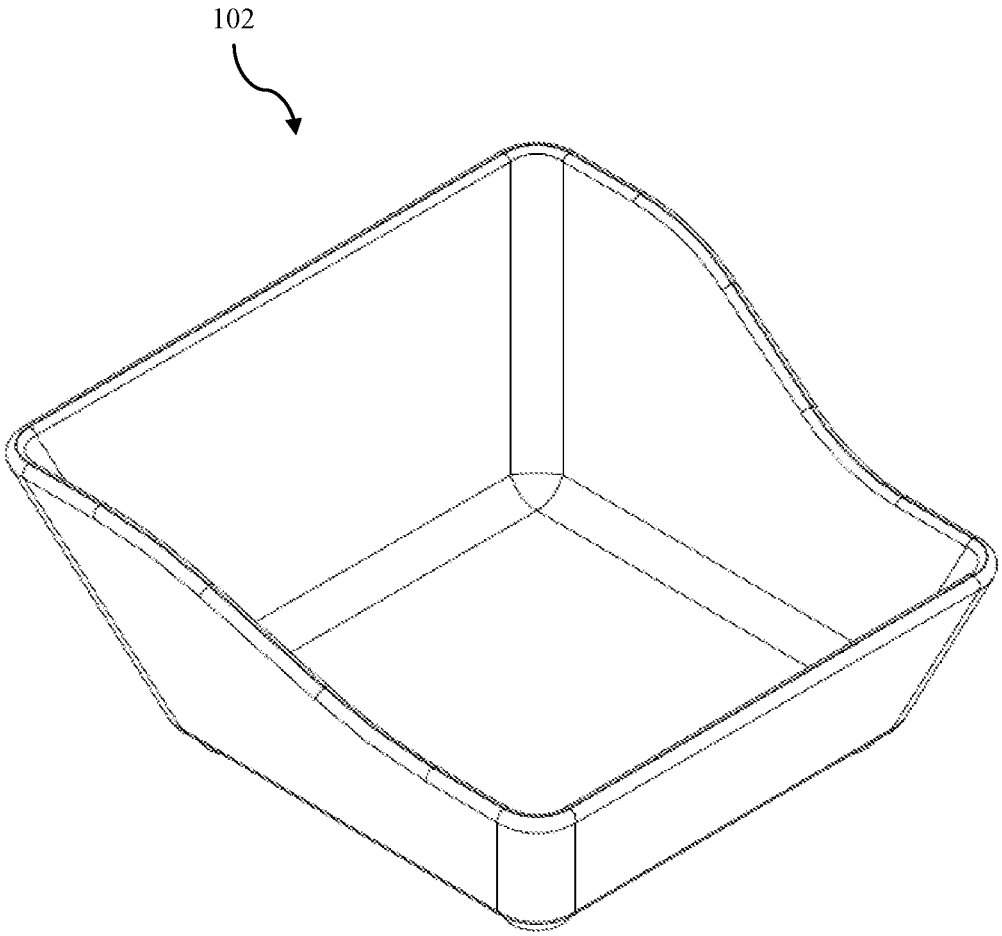
FIG. 8 is a raised view of a tiered bowl according to some embodiments of the present invention.
Figure 9:
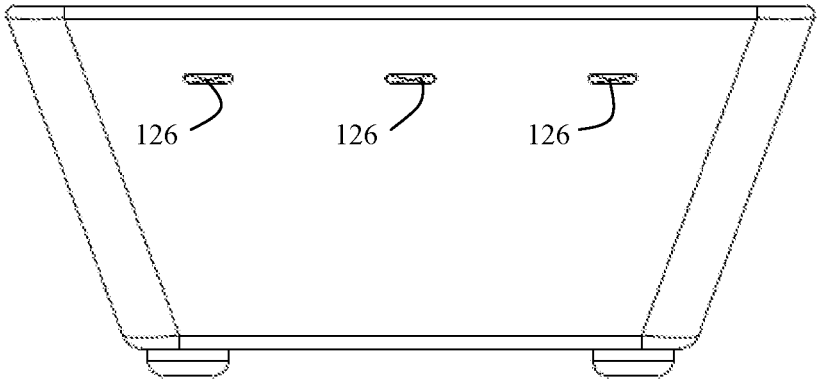
FIG. 9 is a back view of a tiered bowl according to some embodiments of the present invention.
Figure 10:
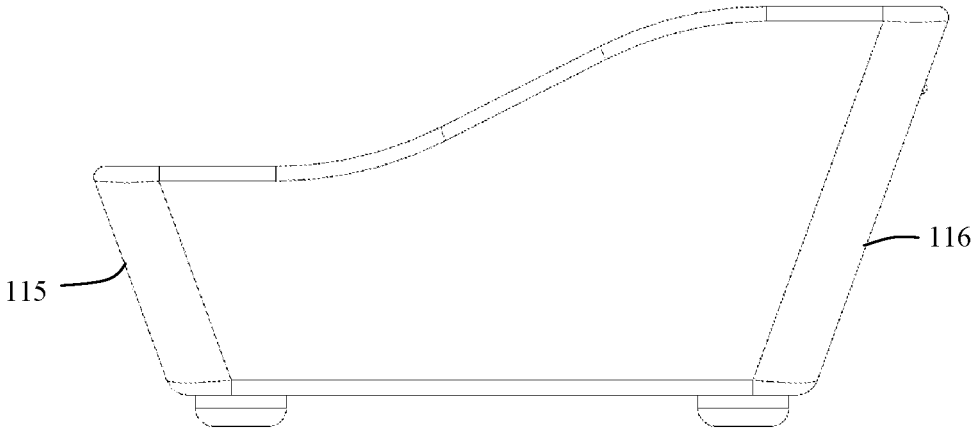
FIG. 10 is a side view of a tiered bowl according to some embodiments of the present invention.
Figure 11:
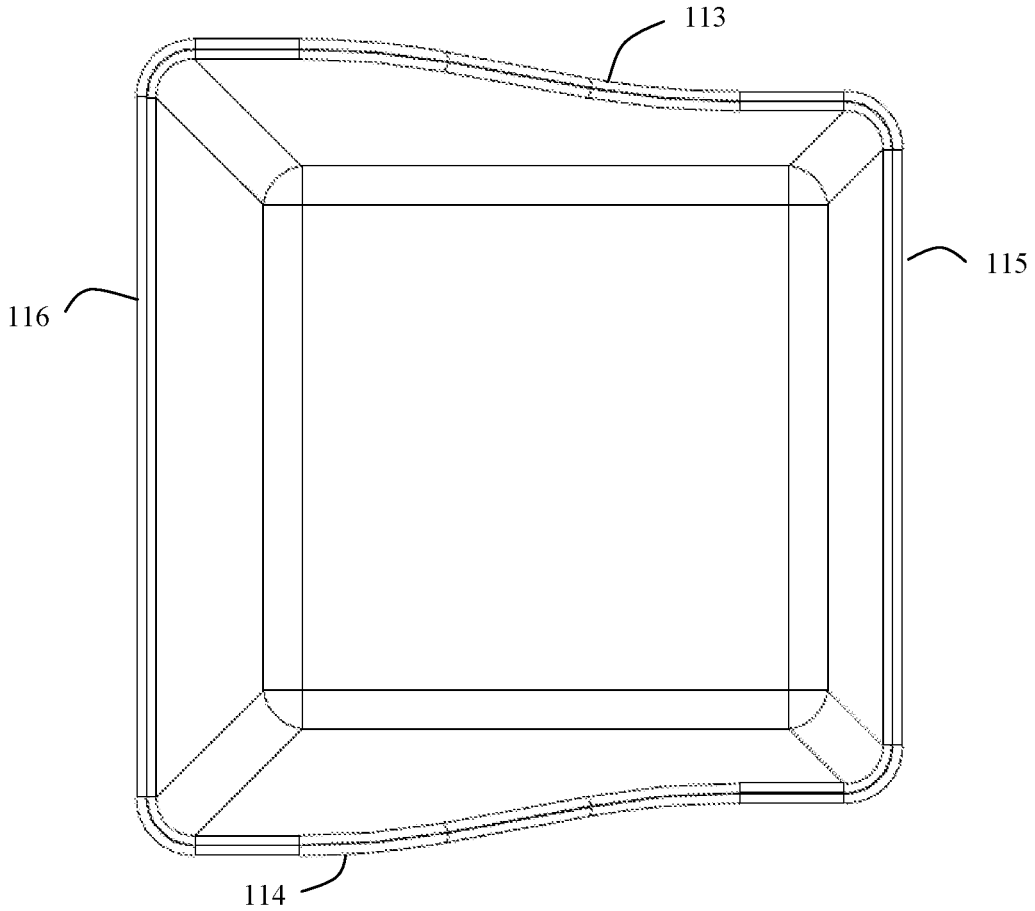
FIG. 11 is a top view of a tiered bowl according to some embodiments of the present invention.
Figure 12:
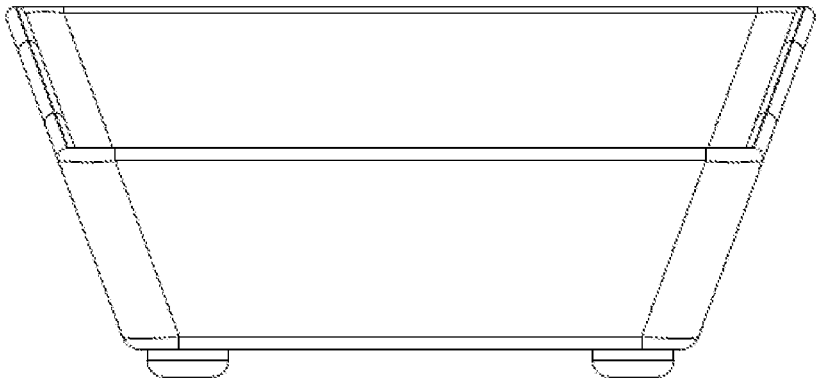
FIG. 12 is a front view of a tiered bowl according to some embodiments of the present invention.
Figure 13:
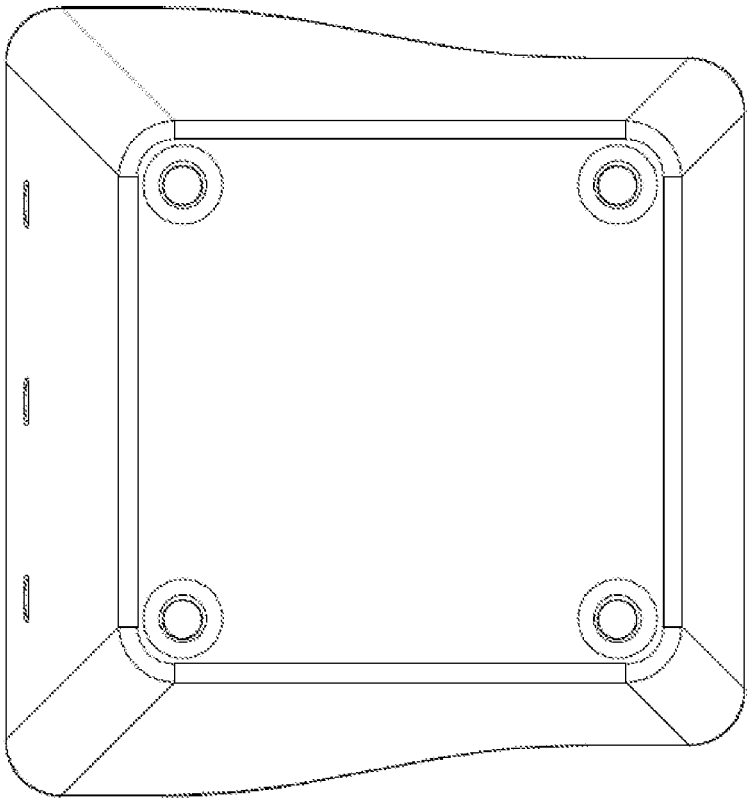
FIG. 13 is a bottom view of a tiered bowl according to some embodiments of the present invention.

FIG. 7 illustrates the bowl lip 103 engaged to the rear 116 of the bowl 102. As further illustrated in a cross-sectional view of the bowl lip 103 in FIG. 14, the bowl lip 103 has an opening 123 adapted to slide over the top 125 of the rear 116. As the bowl lip 103 slides down over upper portion of the rear 116, the opening 123 may be further spread as it goes over the protrusions 126 on the back surface of the rear 116, which are seen in FIG. 9, for example. As the bowl lip 103 fully engages the rear 116, recesses 122 within the interior of the bowl lip engage with the mating feature aspects of the protrusions 126, such that the bowl lip will not easily or inadvertently become dislodged. Also, as the bowl lip 103 fully engages the rear 116, the top 125 of the rear 116 of the bowl 102, which may have a rounded feature, engages within an interior mating feature 124 within bowl lip 103.

Figure 15:
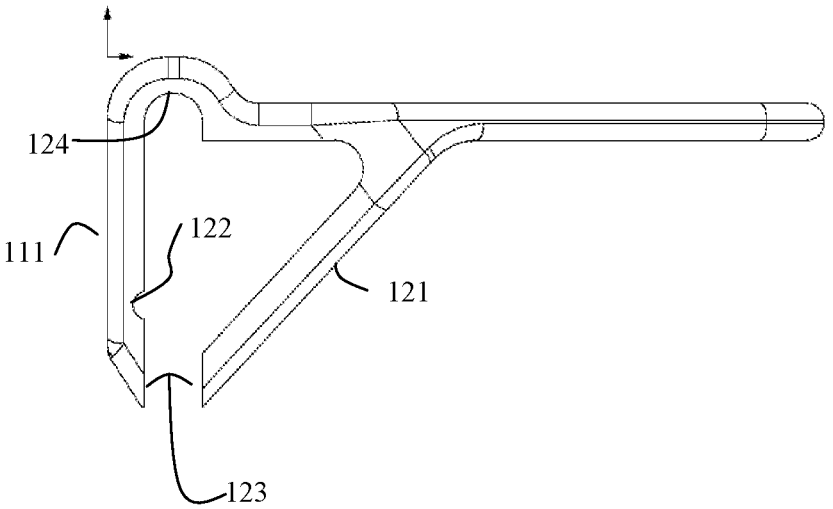
FIG. 15 is a side view of a bowl lip according to some embodiments of the present invention.
Figure 16:
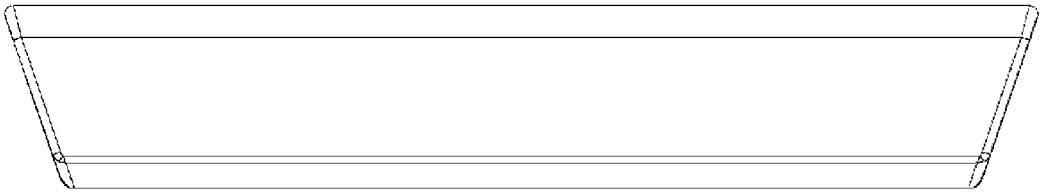
FIG. 16 is a rear view of a bowl lip according to some embodiments of the present invention.
Figure 17:
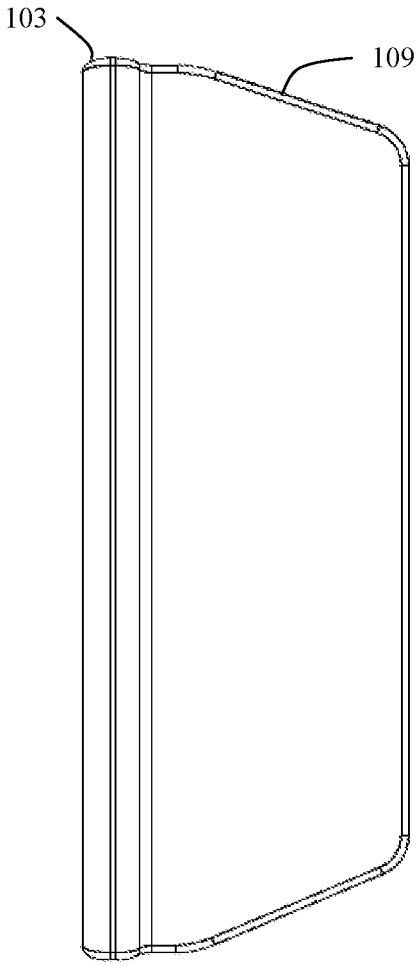
FIG. 17 is a top view of a bowl lip according to some embodiments of the present invention.
Figure 18:
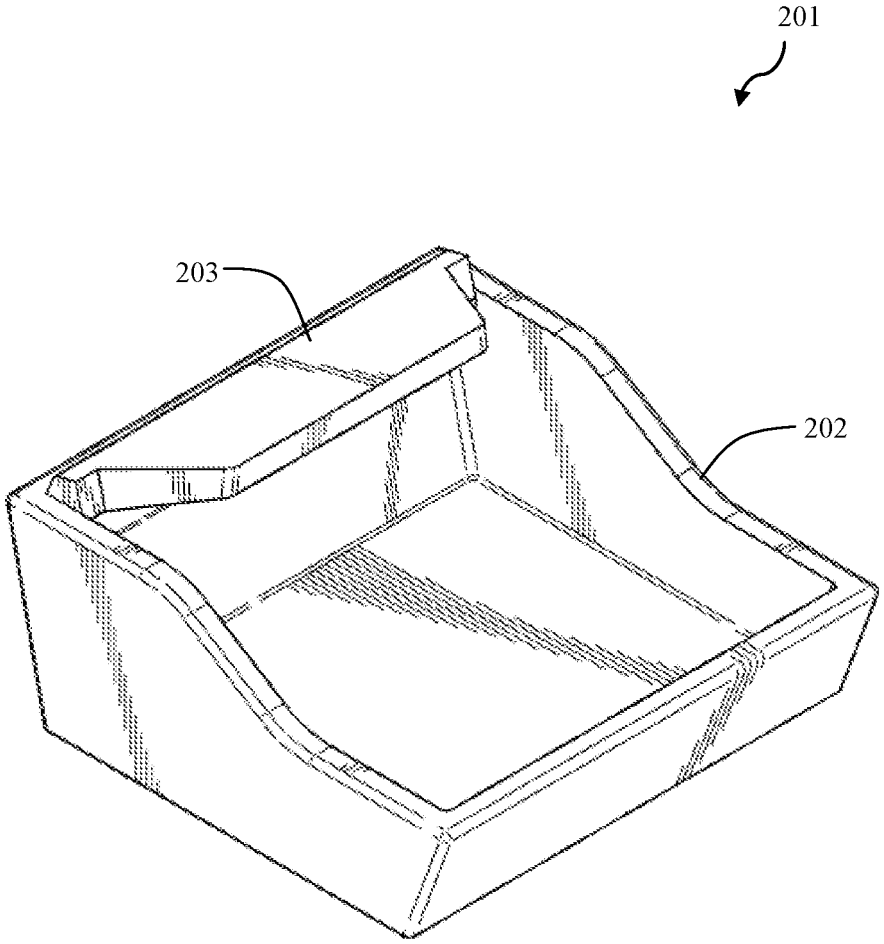
FIG. 18 is a raised view of a tiered bowl with lip according to some embodiments of the present invention.
Figure 19:
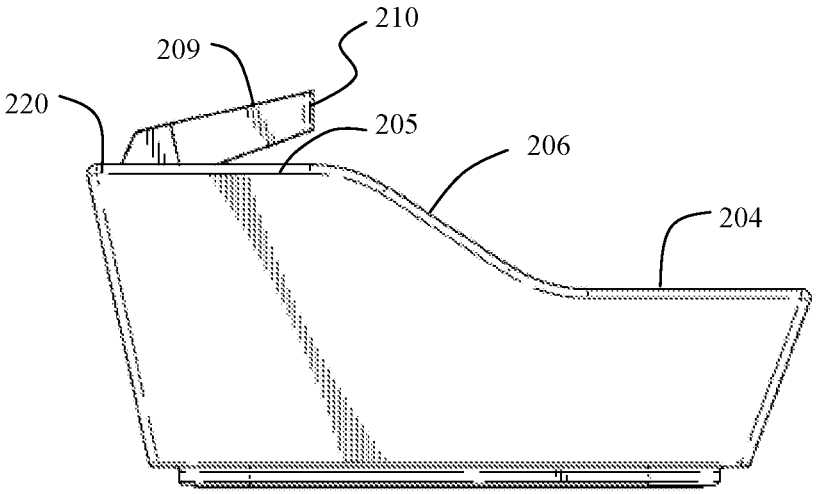
FIG. 19 is a side view of a tiered bowl with lip according to some embodiments of the present invention.
Figure 20:
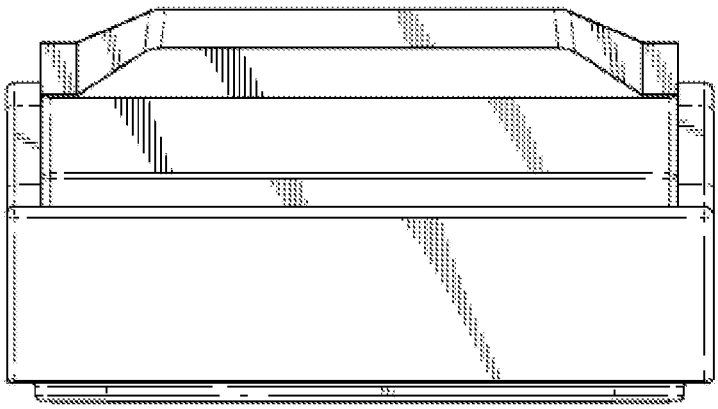
FIG. 20 is a front view of a tiered bowl with lip according to some embodiments of the present invention.
Figure 21:
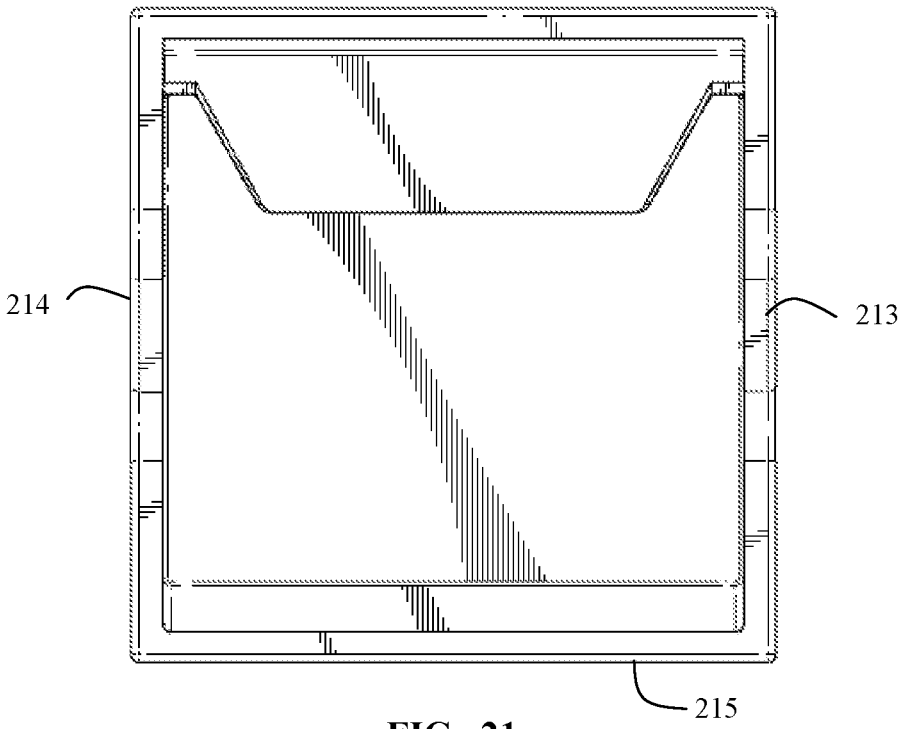
FIG. 21 is a top view of a tiered bowl with lip according to some embodiments of the present invention.
Figure 22:
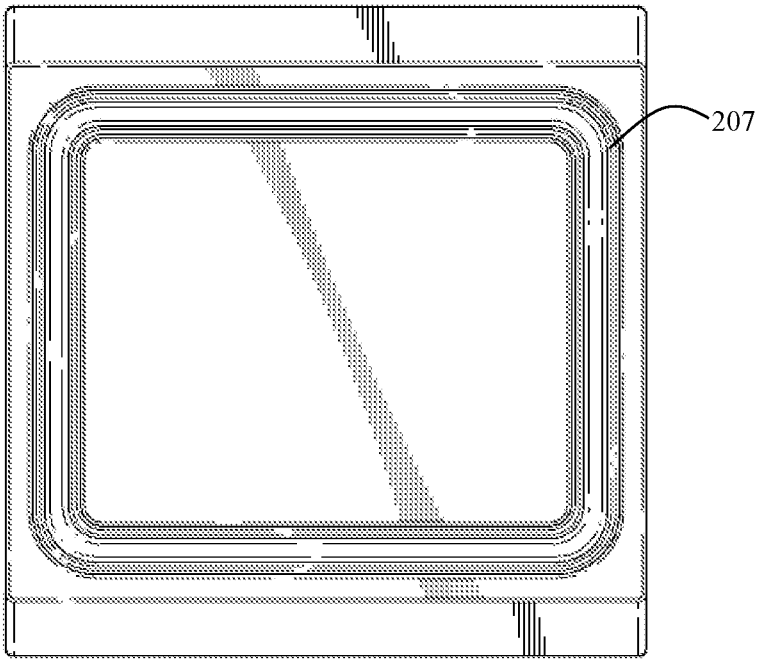
FIG. 22 is a bottom view of a tiered bowl with lip according to some embodiments of the present invention.

FIGS. 7 and 15 also illustrate an inner pushing surface 121 according to embodiments of the present invention. The inner pushing surface may start along interior side of the opening 123 of the bowl lip 103, and rise up and inward. The inner pushing surface 121 may then end into the bottom surface of the remaining portion of the overhang 109 of the bowl lip 103. In some aspects, the inner pushing surface 121 may be a surface with a linear profile. In some aspects, the inner pushing surface 121 may be a surface with a curved profile.

The inner pushing surface 121 allows a user who has dipped a dipping item into the bowl to position, or push, the food item further onto the middle portion of the dipping item, away from the edge of the dipping item, by pushing the foodstuff item after it has been scooped out by the dipping item. This may allow for a greatly reduced likelihood of the food item to fall off of the dipping item as it is removed from the bowl and directed towards the user's mouth, for example.

FIGS. 8-13 illustrate a bowl 102 according to some embodiments of the present invention. The tiered bowl 102 may have a tiered bowl encompassed by a front 115, sides 113, 114, a rear 116, and a bottom 112. The sides 113, 114 may have a top surface having a first, lower, portion 104 which may the same height as the top surface of the front 115. The top surface of the sides 113, 114 may also have a second, higher, portion 105 which may be the same height of the top surface of the rear 116. An intermediate portion 106 may bridge the first portion 104 and the second portion 105 of the sides 113, 114.

FIGS. 14-17 illustrate a bowl lip 103 according to some embodiments of the present invention. The bowl lip 103 has an overhang 109 out to a lip edge 110. The bowl lip 103 has an opening 123 adapted to slide over the top of the rear wall of the bowl. As the bowl lip 103 fully engages the rear wall of the bowl, recesses 122 within the interior of the bowl lip engage with the mating feature aspects 126 of the protrusions of the bowl, such that the bowl lip will not easily or inadvertently become dislodged. The bowl lip may, however, be removed for cleaning or replacement with a bit more force.

Figure 14:
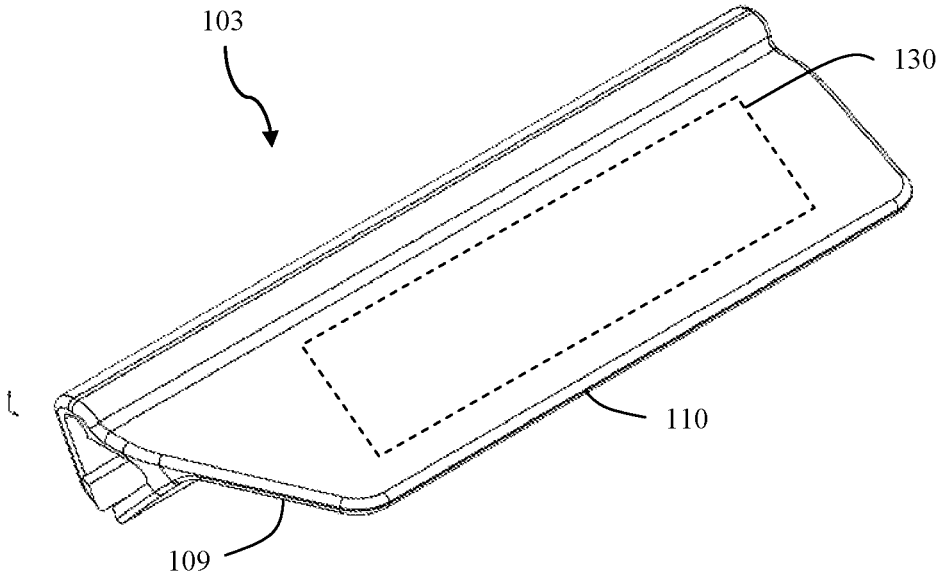
FIG. 14 is a raised view of a bowl lip according to some embodiments of the present invention.

As seen in FIG. 14, a display area 130 may be used to display a message, such as branding with a corporate logo, or of a restaurant identification, or with a commemoration of a special event, such that the customization need only involve the bowl lip and not the bowl. In some aspects, the display area 130 may be recessed into the top surface of the overhang 109. In some aspects, another portion of the bowl lip 103 may be used for display.

In some embodiments, the bowl lip may be of a unitary construction with the bowl, such as a single co-molded piece including the bowl and lip, for example. In some embodiments of the present invention, as seen in FIGS. 18-23, a tiered bowl system 201 is seen with a tiered bowl 202 and a bowl lip 203. The tiered bowl is adapted to contain a material such as a food meant to be dipped into, as with tortilla chips, for example. In an exemplary use, the bowl 202 may hold a thicker dipping material, such as guacamole. A user may then dip a tortilla chip into the guacamole, and is able to remove some of the guacamole by wiping it against the underside of the bowl lip 203.

The tiered bowl 202 may have a tiered bowl encompassed by a front 215, sides 213, 214, a rear 216, and a bottom 212. The sides 213, 214 may have a top surface having a first, lower, portion 204 which may the same height as the top surface of the front 215. The top surface of the sides 213, 214 may also have a second, higher, portion 205 which may be the same height of the top surface of the rear 216. An intermediate portion 206 may bridge the first portion 204 and the second portion 205 of the sides 213, 214. In some aspects, a tiered effect may be implemented with a sloping side of the tiered bowl 202. In such a case, the top of the rear 216 of the bowl 202 would be at a higher elevation than the elevation of the top of the front 215.

Figure 23:
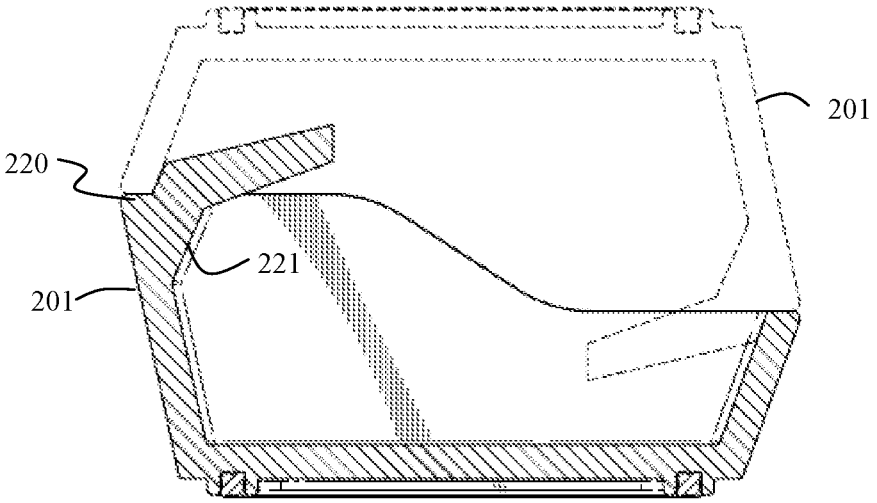
FIG. 23 is a partial cutaway view of a tiered bowl with lip according to some embodiments of the present invention.

The bowl lip 203 has an overhang 209 out to a lip edge 210. The tiered bowl 102 may have a foot structure 207, which may be rectangular. FIG. 23 illustrates an inner pushing surface 221 according to embodiments of the present invention. The inner pushing surface may start along the rear wall of the bowl, and rise up and inward. The inner pushing surface 221 may then end into the bottom surface of the remaining portion of the overhang 209 of the bowl lip 203.

A feature, which may be a plateau 220 on the upper back surface of the rear 216 of the bowl 202 may mate with the top of the front 215 when the bowls are stacked top to bottom, as seen in 23. This stacking method may be used with bowls with a unitary structure of bowl and lip, for example.

FIGS. 24 and 25 illustrate the stacking of bowls 102 according to some embodiments of the present invention. The sloping sides, front, and rear of the bowls 102 allow for compact stacking of the bowls. As seen in FIG. 25, the bowl lips 103 may be placed into the top bowl of a stack of bowls 102, allowing for compact stowage of the bowls 102 and bowl lips 103.

As evident from the above description, a wide variety of embodiments may be configured from the description given herein and additional advantages and modifications will readily occur to those skilled in the art. The invention in its broader aspects is, therefore, not limited to the specific details and illustrative examples shown and described. Accordingly, departures from such details may be made without departing from the spirit or scope of the applicant's general invention.

What is claimed is:

1. A food serving bowl system, said serving bowl system comprising:

a bowl, said bowl comprising:

a planar front panel;

a planar right side panel;

a planar left side panel;

a planar rear panel; and a rectangular flat bottom, wherein said front panel, right side panel, left side panel, rear panel and bottom are coupled together to form a bowl structure, wherein said front panel, right side panel, left side panel, and rear panel slope inwards as they descend towards and couple to said bottom, and wherein said right side panel and said left side panel terminate in the rearward direction at said rear panel with none of said right side panel or said left side panel protruding rearward of said rear panel, and wherein said right side panel and said left side panel terminate in the forward direction at said front panel with none of said right side panel or said left side panel protruding forward of said front panel, and wherein said bowl is adapted to stack within a second identical bowl, and wherein the top of said rear panel is higher than the top of said front panel when said bowl is residing on said bottom;

a bowl lip, said bowl lip coupled to the top of said rear panel, said bowl lip comprising a planar overhang extending inward from said rear panel towards said front panel, wherein a planar top surface of said overhang extends inward from the top of said rear panel at a first angle, wherein said bowl lip is removably attached to said bowl, wherein said bowl lip comprises an inner space with an opening, wherein said opening is adapted to fit over the top edge of said rear panel and wherein said bowl lip further comprises a pushing surface under said overhang, wherein said pushing surface is a planar surface beginning at a first end at or near said opening in said bowl lip below the top of said rear panel, and extending upward and outward at a second angle from below the top of said rear panel to a second end on the underside of said overhang, wherein said planar overhang extends further past the intersection of said planar pushing surface.

2. The food serving bowl system of claim 1 wherein the elevation of said right side panel and said left side panel is higher at their rear end coupled to said rear panel than at their front end coupled to said front panel.

3. The food serving bowl system of claim 2 wherein said right side panel and said left said panel comprise:

a front portion with an elevation at the same elevation as said front panel;

a rear portion with an elevation at the same elevation as said rear panel; and an intermediate portion which slopes between said front portion and said rear portion.

4. The food serving bowl system of claim 2 wherein said bowl further comprises feet extending from the bottom of said bowl.

5. The food serving bowl system of claim 4 wherein each of said feet comprise a frictional resilient pad.

6. The food serving bowl system of claim 1 wherein said bowl lip and said bowl further comprise mating features adapted to removably lock said bowl lip onto said bowl.

7. The food serving bowl system of claim 6 wherein said bowl further comprises feet extending from the bottom of said bowl.

8. The food serving bowl system of claim 7 wherein each of said feet comprise a frictional resilient pad.

9. The food serving bowl system of claim 1 wherein said bowl further comprises feet extending from the bottom of said bowl.

10. The food serving bowl system of claim 9 wherein each of said feet comprise a frictional resilient pad.

* * * * *